US006557852B1

(12) United States Patent
Cuddy

(10) Patent No.: US 6,557,852 B1
(45) Date of Patent: May 6, 2003

(54) CUBIC SEXENARY (BASE 6) DICE FOR GENERATING RADOM NUMBERS FROM A PREDETERMINED SET

(76) Inventor: Michael Dyer Cuddy, P.O. Box 13480, Baltimore, MD (US) 21203

( * ) Notice: Subject to any disclaimer, the term of this patent is extended or adjusted under 35 U.S.C. 154(b) by 0 days.

(21) Appl. No.: 09/933,089

(22) Filed: Aug. 20, 2001

(51) Int. Cl.[7] ..... A63F 9/04
(52) U.S. Cl. ..... 273/146; 273/138.1
(58) Field of Search ..... 273/146, 139, 273/138.1; D21/369, 372, 373

(56) References Cited

U.S. PATENT DOCUMENTS

| | | | | |
|---|---|---|---|---|
| 3,770,192 A | * | 11/1973 | Tallarida | 235/88 G |
| 4,239,226 A | | 12/1980 | Palmer | |
| 4,497,487 A | | 2/1985 | Crippen | |
| 4,535,994 A | * | 8/1985 | Cowan | 273/146 |
| 5,031,915 A | | 7/1991 | Sanditen | |
| 5,909,874 A | * | 6/1999 | Daniel et al. | 273/146 |
| 5,938,197 A | | 8/1999 | Bowling | |
| 6,158,738 A | | 12/2000 | Van Buskirk | |

* cited by examiner

*Primary Examiner*—Benjamin H. Layno
*Assistant Examiner*—V K Mendiratta

(57) ABSTRACT

Cubic senary (base 6) dice uniquely harness the power of the base 6 number system and generate random numbers from a predetermined set of consecutive numbers, each tending to occur with the same relative frequency. Cubic senary dice have numerical values corresponding to the place values of the base 6 number system, and face values corresponding to the senary notational digits (0, 1, 2, 3, 4, 5). Notational digits on cubic senary dice have two values: an intrinsic value—which is that signified by the isolated symbol itself, and a local value—the value possessed by the numeral by virtue of the power of its die, $6^0$, $6^1$, $6^2$, etc. The magnitude of the senary number cast is a sum of products involving powers of the number 6.

A random senary number is obtained by casting the dice and reading the notational digits returned from each die cast, in order, from the highest to the lowest power die. The random senary number is converted to its decimal equivalent with a calculator. A cast of just seven cubic senary dice can generate any one of $6^7$ or 279,936 random senary numbers ranging from 0 to 5,555,555 consecutively—equivalent to the decimal numbers 0 to 279,935. The number off cubic senary dice cast would vary depending on user needs; or sample size—the set of consecutive numbers from which the user wants to select random numbers.

2 Claims, 16 Drawing Sheets

CUBIC SEXENARY (BASE 6) DICE FOR GENERATING RADOM NUMBERS FROM A PREDETERMINED SET

CROSS REFERENCE TO RELATED APPLICATIONS

Not Applicable

STATEMENT REGARDING FEDERALLY SPONSORED R&D

Not Applicable

REFERENCE TO SEQUENCE LISTING, A TABLE OR A COMPUTER PROGRAM LISTING APPENDIX

Not Applicable

BACKGROUND OF THE INVENTION

This invention relates to random number generators, specifically the use of cubic dice to generate random numbers from a predetermined set. Random number generators are used in commerce, industry, and education; for statistical sampling, simulation, and pure mathematical and scientific research. Statisticians have developed several basic sampling methods in order to obtain unbiased samples, that is, samples representative of the population. The most common methods are random, systematic, stratified, and cluster sampling. A sample is a subgroup of the population. By working with a sample rather than the entire population, researchers can save time and money, get more detailed information, and get information that would otherwise be impossible to obtain.

In random sampling, the basic requirement is that for a sample of size n, all possible samples of this size must have an equal chance of being selected. In order to meet this requirement, researchers can use one of two methods. The first method is to number each element of the population and then place the numbers on cards. Place the cards in container, mix them, and then select the sample by drawing the cards. Applicant's invention improves upon this method by using cubic senary dice rather than numbered cards to choose the sample. The second way of selecting a random sample is to use random numbers. Random numbers can be obtained by using a calculator, computer, or a table. The theory behind random numbers is that each digit, 0 through 9, has an equal probability of occurring, so that in every ten digit sequence, each digit has a probability of 1/10 of occurring.

The first random number table, containing 41,600 digits, was published in 1927 by Cambridge University Press. The need for larger random number tables increased rapidly—necessitated by very large sampling experiments. With the advent of digital computers, more and more random numbers were required for mathematical modeling and forecasting. Since computer memory was, at one time, too expensive to store random number tables, random numbers began to be generated by computers, programmed with random number algorithms.

These pseudo-random numbers, generated by computers, are statistically indistinguishable from genuine random numbers; but numbers generated by computer through a deterministic process cannot, by definition, be random. Given a knowledge of the algorithm used to create pseudo-random numbers and its internal state, it is possible to predict all the numbers returned by subsequent calls to the algorithm. The eminent mathematician John von Neumann stated in a 1951 paper: "Anyone who considers arithmetical methods of producing random digits is, of course, in a state of sin. For . . . there is no such thing as a random number—there are only methods to produce random numbers, and a strict arithmetic procedure of course is not such a method."

Authentic random numbers, those numbers tending to occur with the same relative frequency in which a knowledge of one number or an arbitrarily long sequence of numbers is of no use in predicting the next number, can be generated by using mechanical devices. Probably the most familiar mechanical random number generators in the United States are those used for lotteries.

In a typical lottery random number generator, ten small plastic balls on which the decimal notational digits (0, 1, 2, 3, 4, 5, 6, 7, 8, 9) have been printed, are placed in each of several small plexiglass containers—a separate container for the unit's place, the ten's place, the hundred's place, etc. The plastic balls are energetically agitated and thoroughly mixed with compressed air. A ball is released from each container until a three or four digit number has been selected.

The drawing of the winning numbers is aboveboard and transparent to viewers. The public, both scientist and layperson alike, understands and trusts the random process by which the winning number is selected, and its inherent fairness. Confident public assurance of a lottery's fair outcome, largely attributable to the mechanical random number generators used, is instrumental in garnering public support and participation in lotteries worldwide.

Since these devices are too expensive and cumbersome for most applications, except high stake lotteries, other types of mechanical random number generators have been developed, the simplest being dice. When cast, a pair of standard playing dice does not generate random numbers because the numbers from 2 to 12 tend to occur with different relative frequencies. However, random number generators using dice of various geometric shapes and markings have been patented. Unfortunately, most of these devices have deficiencies in terms of conceptual simplicity, fabrication cost, lack of consumer confidence regarding true randomness, user interface, and dynamic range.

Van Buskirk discloses in U.S. Pat. No. 6,158,738 a die for generating random numbers. Bowling discloses in U.S. Pat. No. 5,938,197 a random number generating die. Daniel et al. disclose in U.S. Pat. No. 5,909,874 a random number generator using icosahedron decimal dice. Sanditen discloses in U.S. Pat. No. 5,031,915 a random number generator using two elongated die. Crippen discloses in U.S. Pat. No. 4,497,487 a chance device comprising two icosahedrons. Palmer discloses in U.S. Pat. No. 4,239,226 a random number generator using ten-sided dice.

BRIEF SUMMARY OF THE INVENTION

Cubic senary (base 6) dice each have numerical values uniquely corresponding to the place values of the base 6 number system, and face values uniquely corresponding to the senary notational digits (0, 1, 2, 3, 4, 5). The table below illustrates conceptually both the decimal and senary positional numeration systems:

| | | | | | | |
|---|---|---|---|---|---|---|
| Decimal (base 10) | $10^5$ | $10^4$ | $10^3$ | $10^2$ | $10^1$ | $10^0$ |
| Place values⇨ | 100,000's | 10,000's | 1,000's | 100's | 10's | 1's |
| Senary (base 6) | $6^5$ | $6^4$ | $6^3$ | $6^2$ | $6^1$ | $6^0$ |
| Place values⇨ | 7,776's | 1,296's | 216's | 36's | 6's | 1's |

Since the 6 faces of each cubic senary die are marked with the senary notational digits (0, 1, 2, 3, 4, 5). When cast, each die returns a numerical value from 0 to 5. When read from the highest to lowest power die, these notational digits generate a senary number. The decimal value of each die cast is the product of each die's value (6 raised to its exponent's value) multiplied by the notational digit's intrinsic value—0, 1, 2, 3, 4, 5. The magnitude of the number cast is the sum of these products.

Three senary dice would generate senary numbers having 3 digits, ranging from 000 to 555, or from 0 to 215 when converted to decimal. For example, if the number 314 were to result when three cubic senary dice were cast, the 3 would indicate 3 thirty-sixes, the 1 would indicate 1 six, and the 4 would indicate 4 units (i.e. the decimal number 118), and not 3 hundreds, 1 ten and 4 units as in decimal numeration.

Cubic senary dice have several advantages over similar random number generating devices:

1. Cubic dice have been used for centuries by gamblers and mathematicians around the world. The familiar geometry of cubic dice is recognized and trusted to yield a fair outcome, that is, each of the six sides having an equal chance of turning up when cast. Cubic dice are easy to manufacture; and test for balance and symmetry. The relatively large face area on a cubic die allows for relatively large, easy to read, markings. For these reasons, in comparison with multi-faceted dice having more complex geometries, the traditional cube is clearly the winning configuration for random number generating dice.
2. Cubic senary dice are powerful. A handful of cubic senary dice can generate hundreds of thousands of random numbers. A cast of just seven cubic senary dice can generate any one of $6^7$ or 279,936 random numbers, each of which will tend to occur with the same relative frequency. The number of cubic dice cast can easily be adjusted to accommodate user needs for a predetermined set of numbers. If the user wants to generate a million random numbers, eight dice would be cast. If only a thousand random numbers are needed then only four dice need be cast.
3. Generating random numbers with cubic senary dice is easy, and they are fun to use. The markings are clear, unambiguous, and easy to read. Concepts from the familiar decimal number system make the transition to the senary numbers easy. One quickly becomes accustomed to the base 6 number system when using cubic senary dice, giving one a sense of satisfaction and enjoyment from mastering a new and useful art.

In a preferred embodiment, for those who lack the inclination to reckon with senary numbers, cubic senary dice are marked with the familiar scientific notation format, so that it is unnecessary to work with senary (base 6) numbers when casting cubic senary dice. Also, in alternative embodiments, cubic senary die faces are marked with their decimal equivalents, and the cast evaluated by simple addition.

DETAILED DESCRIPTION OF A PREFERRED EMBODIMENT

Figure 1:
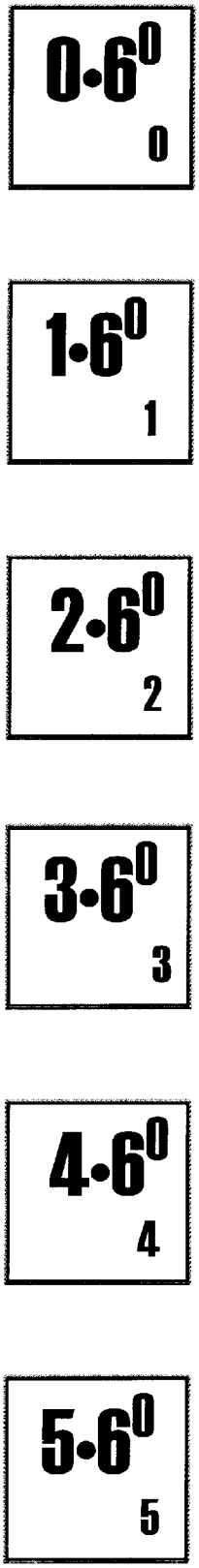
FIG. 1 shows the six faces of the first senary die, $6^0$, representing the 1's die in senary numeration (equivalent to the unit's place in a positional numeration system). The number of units is denoted by the senary notational digits 0 to 5 in black. When symmetrically marked with these notational digits, cubic senary dice have opposite sides totaling to 5, whereas the pips on opposite sides of ordinary dice total to 7. Since all senary dice use 6 as a numerical base and (0, 1, 2, 3, 4, 5) as notational digits, the feature that uniquely characterizes each die is its exponent's value. The white number on the bottom of each die denotes each face's decimal value.
Figure 2:
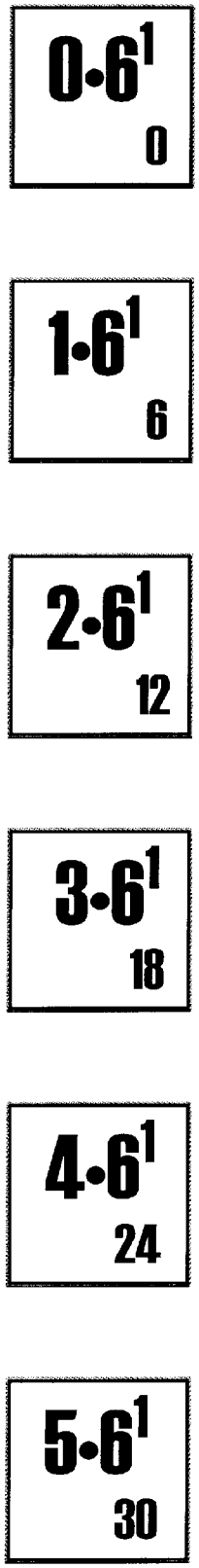
FIG. 2 shows the six faces of the second senary die, $6^1$, representing the 6's die.
Figure 3:
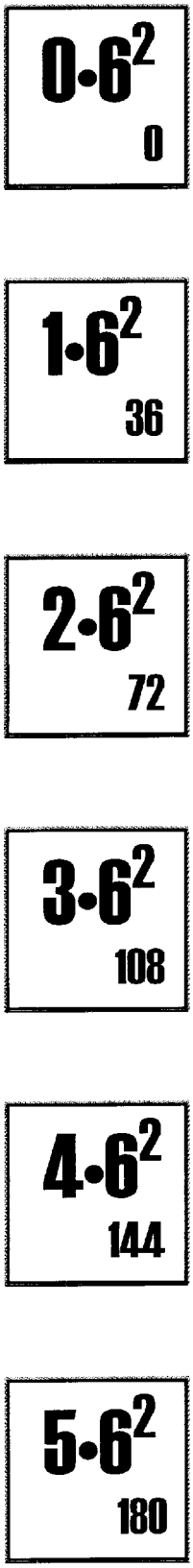
FIG. 3 shows the six faces of the third senary die, $6^2$, representing the 36's die.
Figure 4:
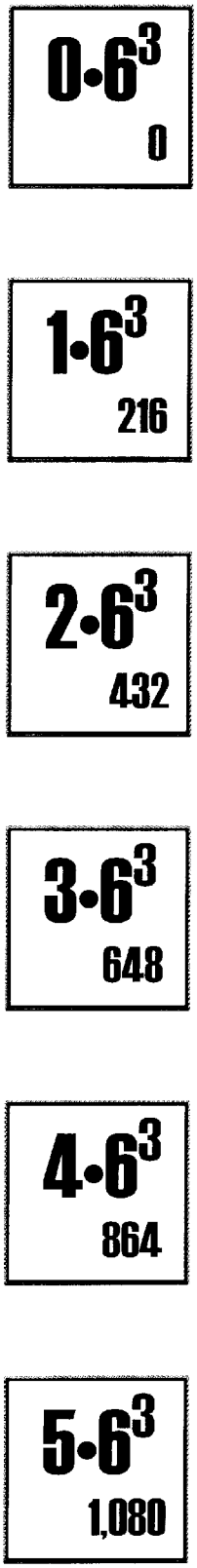
FIG. 4 shows the six faces of the fourth senary die, $6^3$, representing the 216's die.
Figure 5:
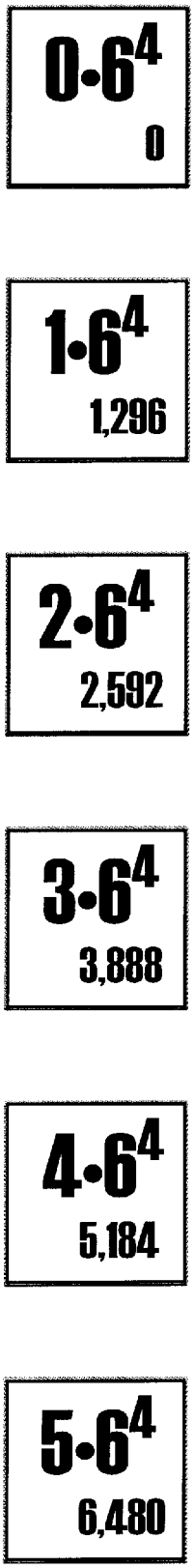
FIG. 5 shows the six faces of the fifth senary die, $6^4$, representing the 1,296's die.
Figure 6:
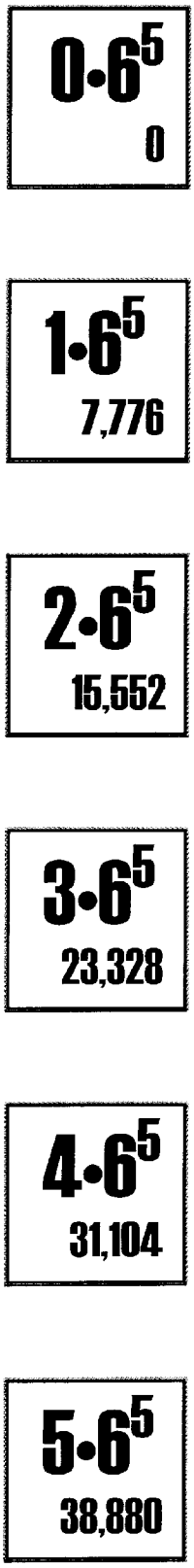
FIG. 6 shows the six faces of the sixth senary die, $6^5$, representing the 7,776's die.
Figure 7:
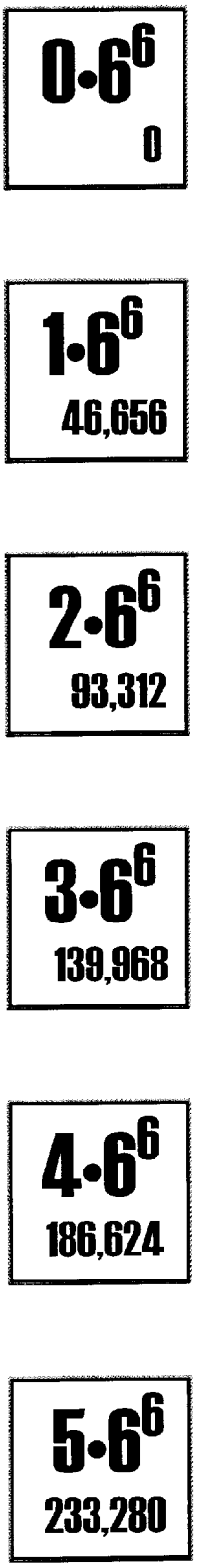
FIG. 7 shows the six faces of the seventh senary die, $6^6$, representing the 46,656's die.
Figure 8:
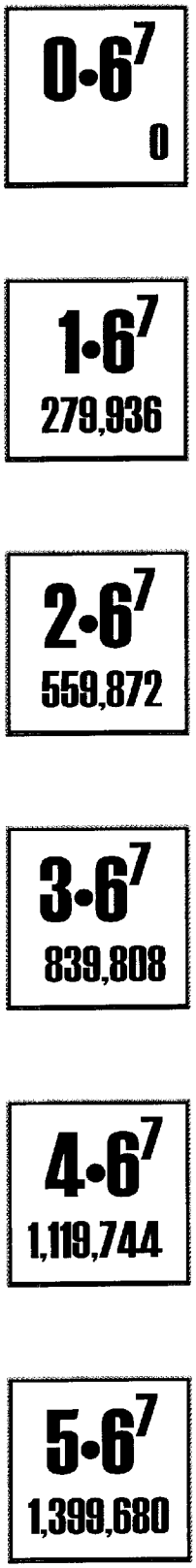
FIG. 8 shows the six faces of the eighth senary die, $6^7$, representing the 279,936's die.
Figure 9:
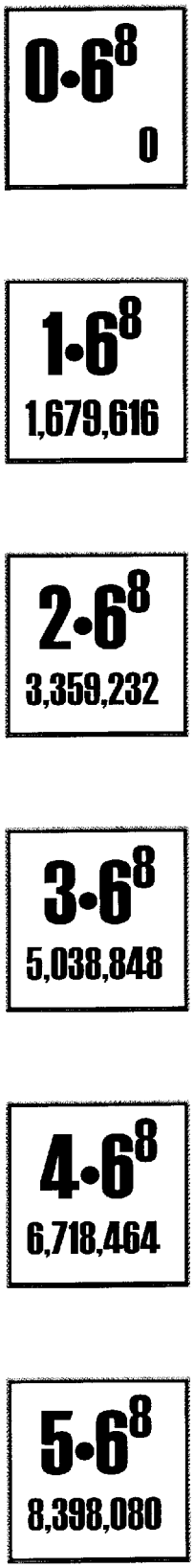
FIG. 9 shows the six faces of the ninth senary die, $6^8$, representing the 1,679,616's die.
Figure 10:
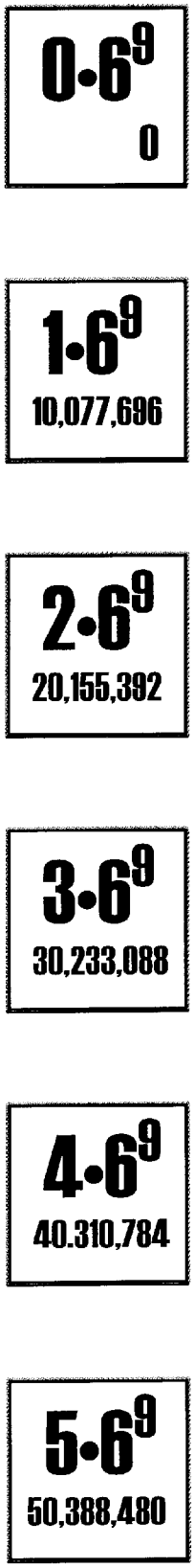
FIG. 10 shows the six faces of the tenth senary die, $6^9$, representing the 10,077,696's die.
Figure 11:
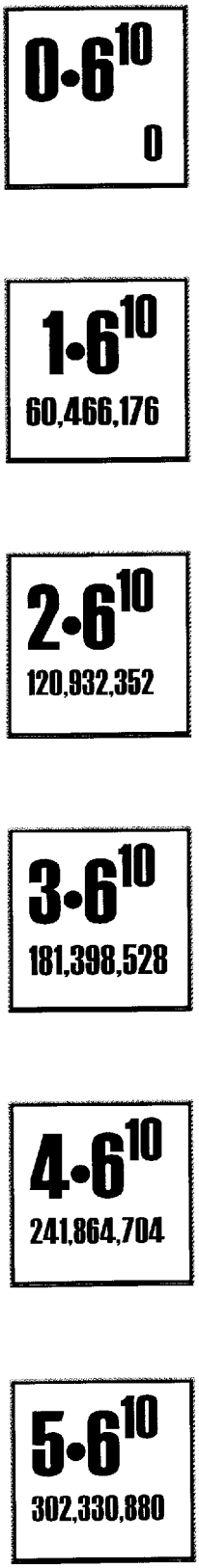
FIG. 11 shows the six faces of the eleventh senary die, $6^{10}$, representing the 60,466,176's die.
Figure 12:
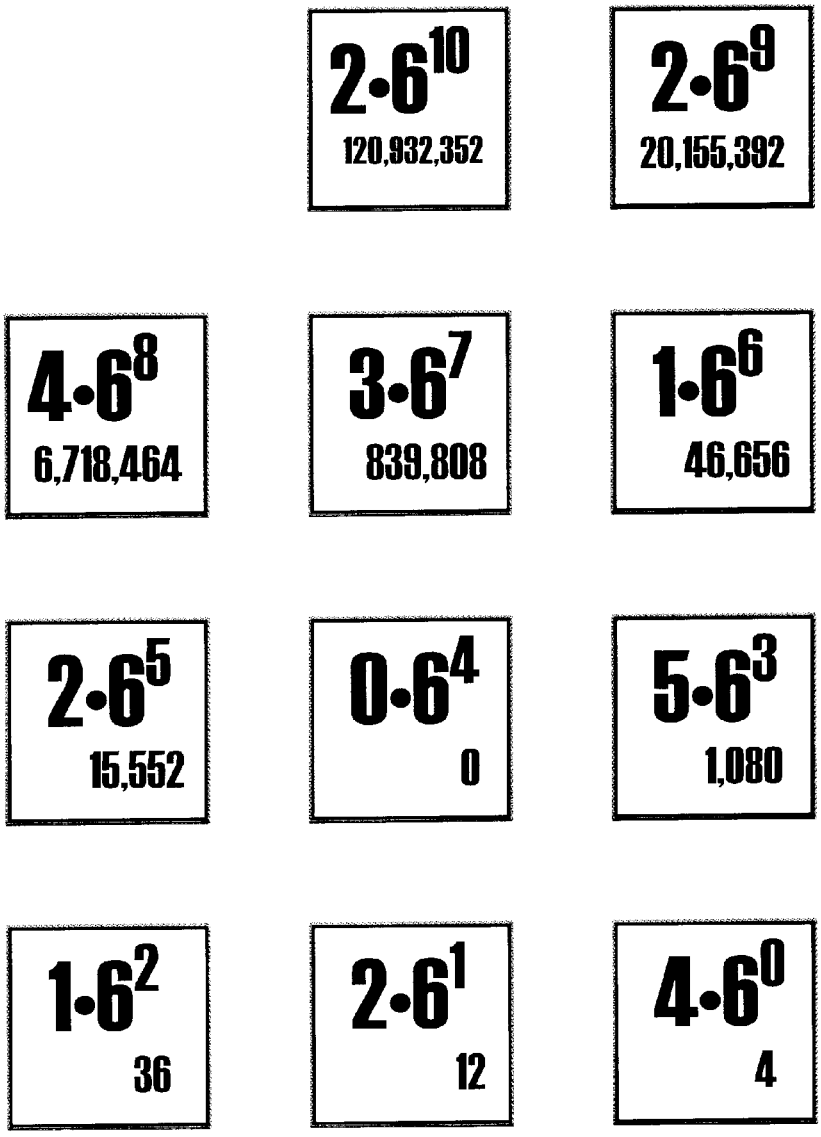
FIG. 12 shows a hypothetical cast of eleven senary dice generating the senary random number 22,431,205,124 which is equivalent to the decimal number 148,709,356.
Figure 13:
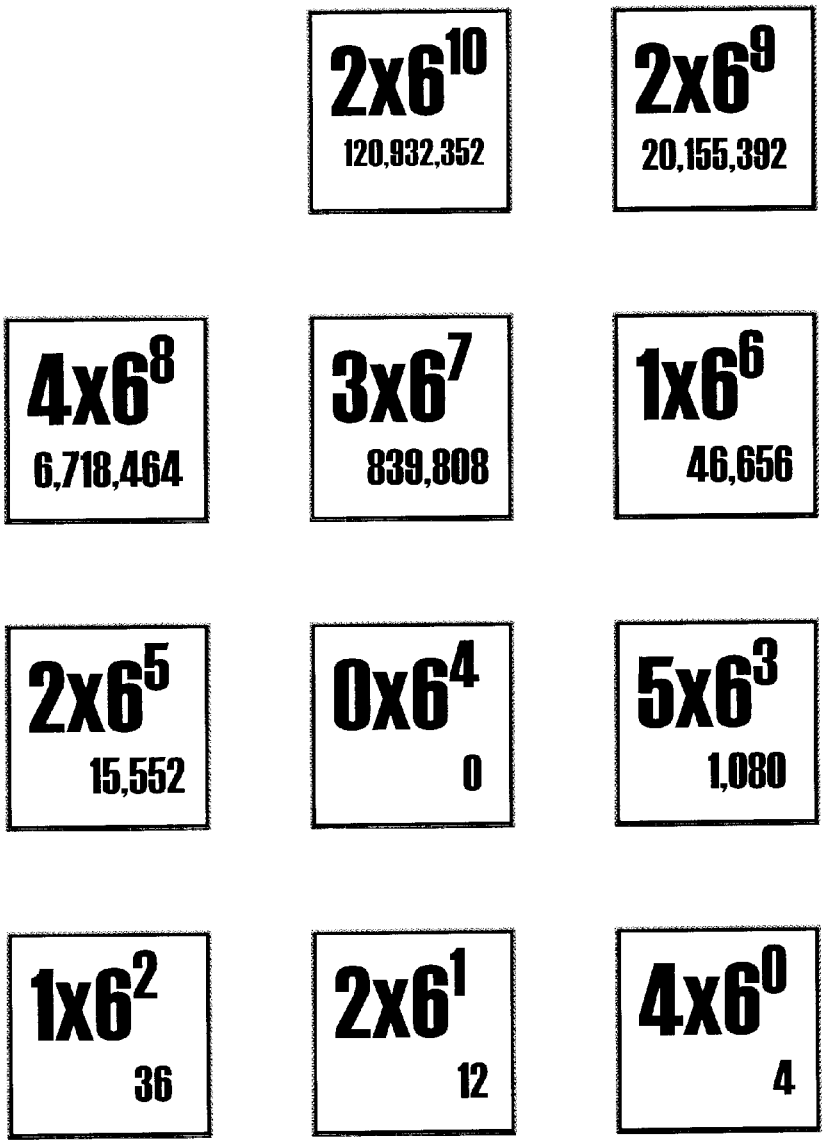
FIG. 13 shows same as FIG. 12, but using an 'x' as the multiplication symbol.
Figure 14:
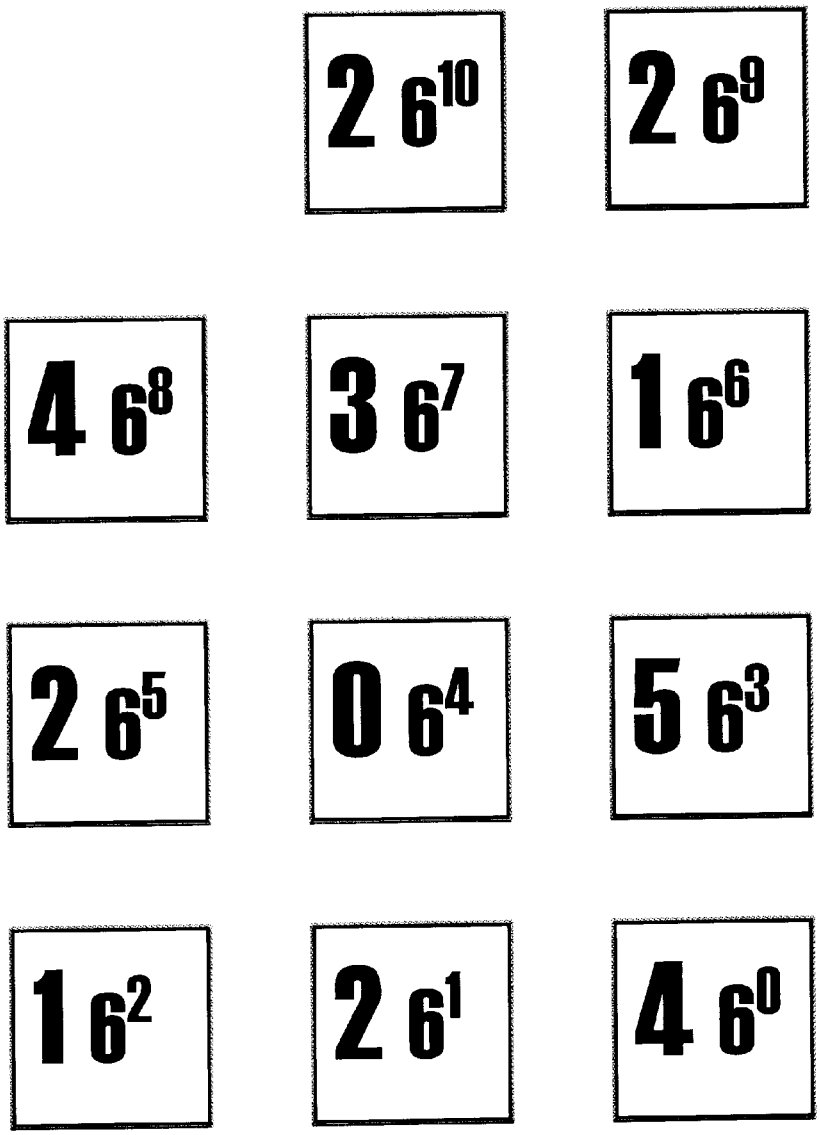
FIG. 14 shows same as FIG. 12 in the preferred embodiment for cubic senary dice. This is the preferred embodiment because all superfluous information is eliminated (multiplication symbol and decimal number) allowing for large symbols to be stamped on dice for easy reading.
Figure 15:
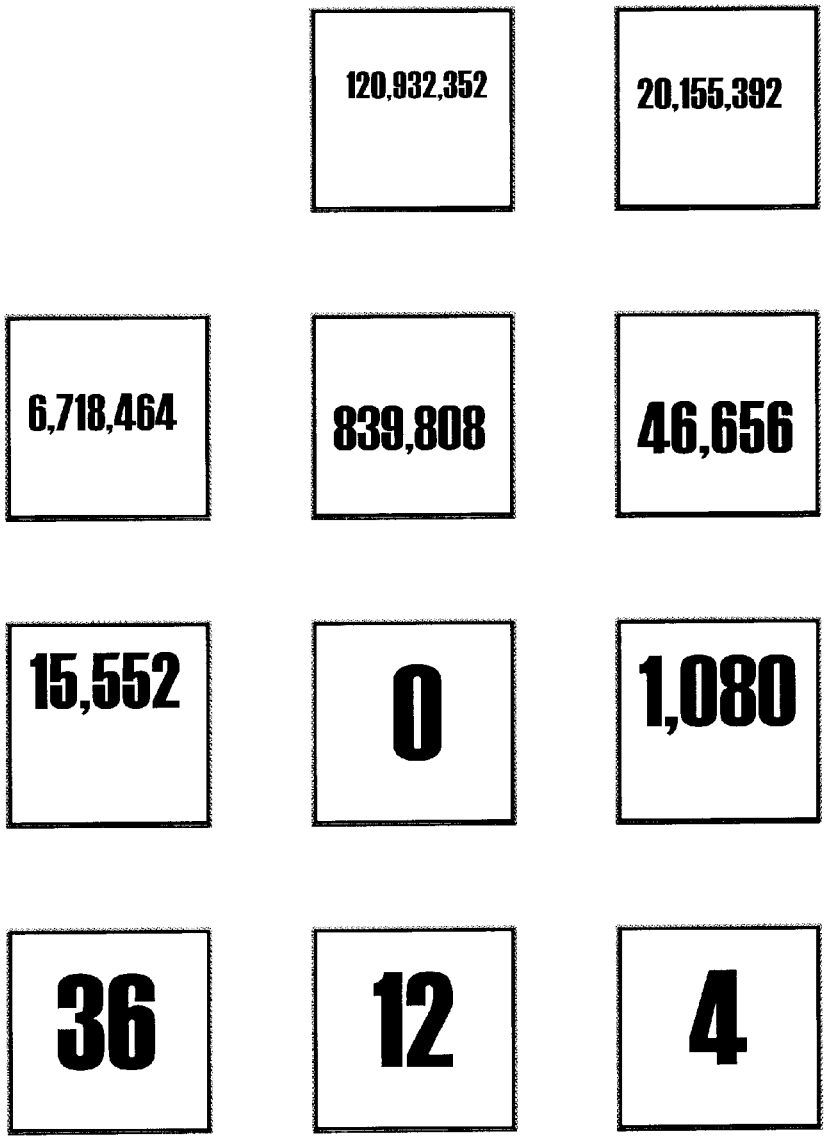
FIG. 15 shows same as FIG. 12 in alternative embodiment with the cubic senary dice having only decimal numbers on each face.

When cast, refer to FIG. 14 for a preferred embodiment, cubic senary dice generate senary numbers because each successive die's numerical value uniquely corresponds to the place values of the base 6 number system and the faces of each die uniquely correspond to the senary notational digits—0 to 5.

A senary number is obtained by casting the dice and then concatenating the notational digits each die returns, in order, from the highest to the lowest power die. For instance, in FIG. 14's hypothetical cast of dice, the senary number 22,431,205,124 was generated. This senary number can then be converted to a decimal number with a handheld calculator programmed for senary to decimal conversion.

Alternatively, rather than finding the senary number, then converting to decimal, the simplest and fastest approach for obtaining a decimal random number would be to sum the outcomes of all dice cast using scientific notation format. For instance, FIG. 14's hypothetical cast of the senary number 22,431,205,124 can be converted to a decimal number by making calculator entries in the following manner using scientific notation format:

$$2\times6^{10}+2\times6^{9}+4\times6^{8}+3\times6^{7}+1\times6^{6}+2\times6^{5}+0\times6^{4}+5\times6^{3}+1\times6^{2}+2\times6^{1}+4\times6^{0}=148{,}709{,}356$$

The number of cubic senary dice cast would depend on the needs of the user. A single die will generate $6^1$ or 6 random senary numbers, from 0 to 5, equivalent to the decimal numbers from 0 to 5. Three dice will generate $6^3$ or 216 random senary numbers, from 0 to 555, equivalent to the decimal numbers from 0 to 215. Five dice will generate $6^5$ or 7,776 random senary numbers, from 0 to 55,555 which are equivalent to the decimal numbers from 0 to 7,775.

The number of cubic senary dice that could be used to generate random senary numbers would reach a practical limit at about 15 dice which will generate $6^{15}$ or 470,184,984,576 random senary numbers, from 0 to 555,555,555,555,555 which are equivalent to the decimal numbers from 0 to 470,184,984,575. Casting more than 15 dice would probably be unnecessary, unwieldy and cause most handheld calculators to overflow.

DESCRIPTION OF ALTERNATIVE EMBODIMENTS

To facilitate the use the cubic senary dice without a calculator, die faces can be marked with decimal equivalents. FIGS. 1–13 & 15.

Figure 16:
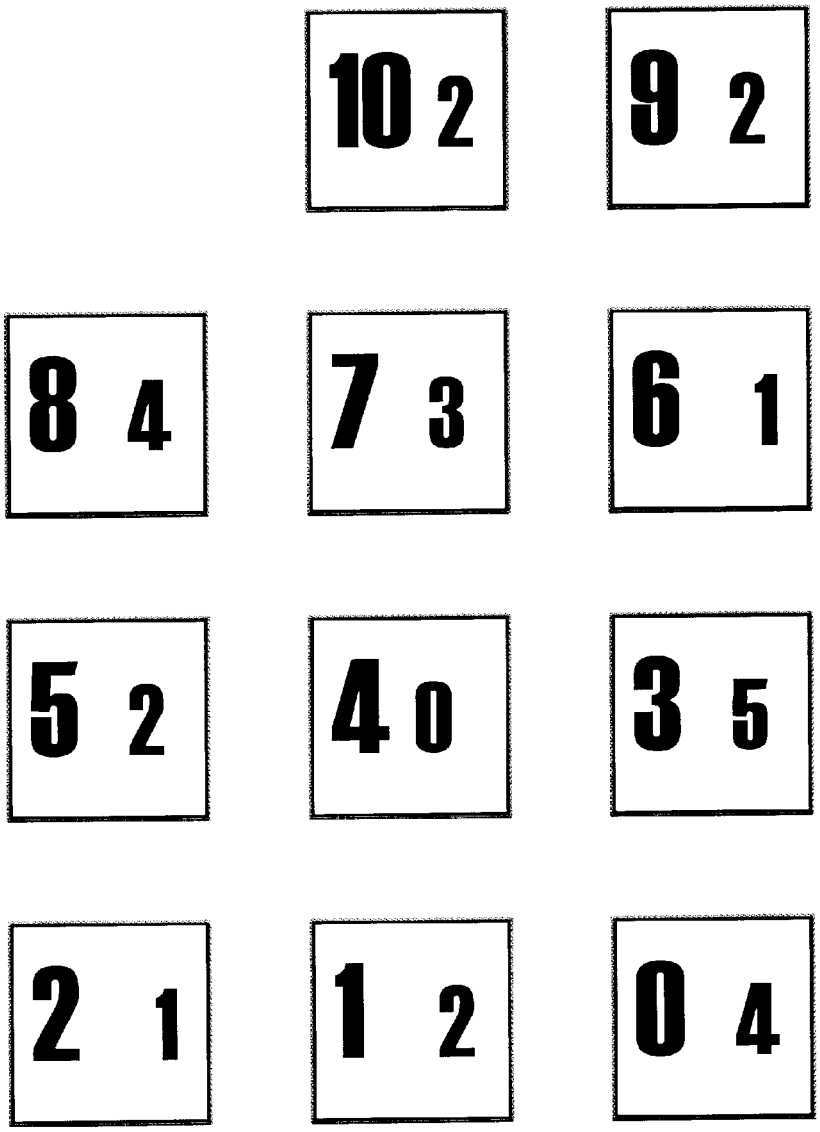
FIG. 16 shows in an alternative embodiment, the same hypothetical cast as shown in FIG. 12. In this embodiment, the power of each die is shown in white and the senary notational digits in black. This allows for large symbols for easy reading of dice when cast.

Another embodiment is shown in FIG. 16 in which the power of each die is marked in white numbers and the notational digits in black. The numerals on each die have two values: the intrinsic value of the numeral—that signified by the isolated symbol itself, and a local value. The local value is that possessed by the numeral by virtue of the power of its die—$6^0$, $6^1$, $6^2$, etc.—similar in concept to place value in positional numeration systems. The magnitude of a random number cast with cubic senary dice is a sum of products involving powers of the number 6, whereas the magnitude of a number cast with ordinary dice is simply a sum of notational digits.

A minimalist design would be to mark each die only with the senary notational digits (0, 1, 2, 3, 4, 5) and use colors, or some other marking scheme, to represent the die's power. For instance, the colors of the spectrum of visible light (red, orange, yellow, green, blue, indigo, and violet) could reference the $6^6$, $6^5$, $6^4$, $6^3$, $6^2$, $6^1$, $6^0$ dice respectively. This method would allow for highly visible notational digits on relatively small dice.

In light of the foregoing disclosure, numerous variations in the construction and marking of cubic sexenary dice, within the scope of the appended claim, will occur to those skilled in the art.

I claim:

1. An apparatus for generating random numbers comprising, in combination, a set of at least two cubic dice:

a. each die being marked with a first numerical value of 6 raised to a power from $6^0$ to $6^{n-1}$ successively, where n is the number of said dice, and;

b. each die having six faces and each face of each die being marked with a second numerical value uniquely corresponding to the senary (base 6) notational digits (0, 1, 2, 3, 4, 5), successively, whereby when said cubic dice are cast, they are capable of generating $6^n$ unique numbers, each number tending to occur with the same relative frequency.

2. The apparatus for generating random numbers according to claim 1, comprising, in combination, a set of n cubic dice wherein each face of each die is marked with said first and second numerical values in scientific notational format as $0\times6^0$ to $5\times6^0$ (dice #1), $0\times6^1$ to $5\times6^1$ (dice #2) . . . $0\times6^{n-1}$ to $5\times6^{n-1}$(dice #n), successively.

* * * * *

UNITED STATES PATENT AND TRADEMARK OFFICE

CERTIFICATE OF CORRECTION

PATENT NO. : 6,557,852 B1
DATED : May 6, 2003
INVENTOR(S) : Michael D. Cuddy

It is certified that error appears in the above-identified patent and that said Letters Patent is hereby corrected as shown below:

Title page, Item [54] and Column 1, line 1,
Title, replace "SEXENARY" with -- SENERY -- and replace "RADOM" with -- RANDOM --.

Title page,
Item [57], ABSTRACT,
Last sentence, replace "off" with -- of -- and replace "sample" with -- population --.

Column 1,
Line 47, remove "or a" and after "table" insert -- of random numbers, or a mechanical device --.

Column 3,
Line 32, remove ";".

Column 4,
Line 3, remove "in black".
Line 9, remove "white".
Line 49, replace "white" with -- large numbers --.
Line 50, replace "black" with -- small numbers --.

Column 5,
Line 36, replace "white" with -- large number --.

Signed and Sealed this

Sixth Day of April, 2004

JON W. DUDAS
*Acting Director of the United States Patent and Trademark Office*